US006405958B1

(12) United States Patent
Behrens et al.

(10) Patent No.: US 6,405,958 B1
(45) Date of Patent: Jun. 18, 2002

(54) METHOD AND APPARATUS FOR MINIMIZING THE COIL HEIGHT OF WIRE IN A COIL FORMING CHAMBER

(75) Inventors: Holger Behrens, Erkrath; Hans-Georg Hartung, Pulheim; Rüdiger Grimmel, Netphen; Karl Keller, Hilchenbach, all of (DE)

(73) Assignee: SMS Schloemann-Siemag Aktiengesellschaft, Düsseldorf ( * ) Notice: Subject to any disclaimer, the term of this patent is extended or adjusted under 35 U.S.C. 154(b) by 0 days.

(21) Appl. No.: 09/368,814

(22) Filed: Aug. 5, 1999

(30) Foreign Application Priority Data

Aug. 8, 1998 (DE) ..... 198 35 962

(51) Int. Cl.[7] ..... B21C 47/10
(52) U.S. Cl. ..... 242/361.1; 242/361.4
(58) Field of Search ..... 242/360, 363, 242/361, 361.1, 361.2, 361.3, 361.4, 362.2

(56) References Cited

U.S. PATENT DOCUMENTS

| | | | | | |
|---|---|---|---|---|---|
| 2,833,329 | A | * | 5/1958 | De Poy | 242/360 X |
| 2,886,258 | A | * | 5/1959 | Haugwitz | 242/361.4 X |
| 3,647,153 | A | | 3/1972 | Schofield | |
| 3,703,261 | A | * | 11/1972 | Cofer et al. | 242/361.4 |
| 4,339,091 | A | * | 7/1982 | Enneking et al. | 242/361.4 X |
| 4,437,620 | A | * | 3/1984 | Ozawa | 242/362.2 X |
| 5,143,315 | A | * | 9/1992 | Faessel et al. | 242/360 |
| 5,273,231 | A | * | 12/1993 | Starvaski | 242/363 |
| 5,374,005 | A | * | 12/1994 | Jenkins et al. | 242/361.4 |
| 5,779,174 | A | * | 7/1998 | Starvaski et al. | 242/363 |
| 6,073,873 | A | * | 8/2000 | Shore et al. | 242/363 |

FOREIGN PATENT DOCUMENTS

| | | | | |
|---|---|---|---|---|
| DE | 1011840 | | 7/1957 | |
| DE | 1586287 | | 1/1972 | |
| DE | 196 20 578 A1 | | 11/1997 | |
| EP | 0442835 | | 8/1991 | |
| EP | 499963 | * | 8/1992 | 242/360 |
| EP | 0583099 | | 2/1994 | |
| EP | 0768126 | | 4/1997 | |
| SU | 1239783 | * | 6/1986 | 242/360 |

* cited by examiner

*Primary Examiner*—William A. Rivera
(74) *Attorney, Agent, or Firm*—Friedrich Kueffner

(57) ABSTRACT

A method and an apparatus for minimizing the coil height of wire coils formed in a coil forming chamber, wherein individual wire windings are conveyed on a horizontal conveyor, the wire windings are allowed to drop at the end of the conveyor in an approximately vertically dropping movement, and the wire windings drop into the coil forming chamber so as to form the coil. The method includes the steps of placing the wire windings $N_w$ from their drop line eccentrically relative to the axis of symmetry of the coil forming chamber, and adjusting an angle offset $\Delta\phi$ between two successive windings in accordance with the number of wire windings which are placed per 360° in the coil forming chamber, wherein the adjustment is constant or variable, and wherein $\Delta\phi=360°/N_w$.

14 Claims, 7 Drawing Sheets

METHOD AND APPARATUS FOR MINIMIZING THE COIL HEIGHT OF WIRE IN A COIL FORMING CHAMBER

BACKGROUND OF THE INVENTION

1. Field of the Invention

The present invention relates to a method and an apparatus for minimizing the coil height of wire coils formed in a coil forming chamber, wherein individual wire windings are conveyed on a horizontal conveyor, the wire windings are allowed to drop at the end of the conveyor in an approximately vertically dropping movement, and the wire windings drop into the coil forming chamber so as to form the coil.

2. Description of the Related Art

In wire rolling mills, finish-rolled wire is placed by means of a winding layer in loops with defined diameters on a conveyor belt, the loops are conveyed on the conveyor belt and cooled as they are conveyed. At the end of the conveying distance, the wire windings are collected in a coil forming chamber and are placed into coils. When the windings drop into the coil forming chamber without any manipulation devices, such as gripping members, hooks, rotating devices for defining the placement positions of the windings, for example, rotating internal mandrels, coils are formed which have a height determined by the randomness of the placement, wherein the windings are placed essentially approximately centrically around an internal mandrel of the coil forming chamber.

The coil height of windings in a coil forming chamber can be decisively influenced by an ordered placement of the windings. This results in a more uniform coil formation than would be the case when the windings are allowed to drop freely into the coil forming chamber. Moreover, an ordered placement makes it possible to more easily uncoil the wire and leads to a higher stability of the wire coils.

EP 0 768 126 A1 discloses a method of minimizing the height of wire coils formed by successively collecting a plurality of wire windings in a coil forming chamber. It is the object of this known method to provide a possibility for minimizing the height of wire coils and for simultaneously achieving a packing of the wire windings in the wire coils which is as tight as possible.

For this purpose, the wire windings are subjected during their essentially vertical dropping movement to an additional horizontal centrifugal movement. The centrifugal movements acting on the individual wire windings produce the result that the wire windings are displaced outwardly to a greater diameter than the diameter determined by the inlet housing and, consequently, the wire windings are offset either relative to the inner circumference of the coil forming chamber or relative to each other. This produces in a simple manner in the coil forming chamber densely packed winding packets or wire coils whose height is reduced and which are inherently stable.

In an apparatus for carrying out this method, a wire winding conveying device is followed by a vertically aligned inlet housing for successive wire windings and by a coil forming chamber underneath the inlet housing. The apparatus is constructed essentially in such a way that an additional wire guiding housing is located in the vertical area located between the inlet housing and the coil forming chamber, wherein the wire guiding housing is driveable so as to move on a horizontal curved path extending around the vertical longitudinal axis of the inlet housing and the coil forming chamber.

DE AS 1 586 287 describes a device for collecting, pressing and tying wire windings which are conveyed in a spread-apart manner. The transfer of the wire windings collected in a ring from the collecting station to a pressing and tying device is such that the compact placement achieved during collection of the wire windings is not changed until tying. Moreover, the centering and guiding effect of the mandrel for the dropping wire windings is to be improved in order to prevent damage to the wire windings and to ensure a problem-free collecting of the wire windings. For this purpose, the mandrels are arranged in the known manner on a rotary table which can be swivelled about a vertical axis and the mandrels are displaceable together with their base plates in the direction of the mandrel axis. Means for minimizing the coil height of wire coils produced by collecting a plurality of wire windings in the coil forming chamber are not provided.

EP 0 583 099 B1 describes a device for receiving loops which drop from a vertical path of a discharge device, and for collecting the loops in a ring-shaped wire coil, with a device for horizontally distributing the loops as they drop downwardly.

The device includes means for defining a circular path which surrounds the vertical path. The device further includes a rotatable guide element with a curved guide surface with an upper edge which extends around a segment of the circular path from a front end toward a rearward end with a downwardly inclined edge, and which upper edge extends from the rearward edge to a lower end and with a guide edge at an angle from the lower end to the front end of a downwardly inclined edge, wherein the guide surface extends into the vertical path and is arranged in such a way that the guide surface comes into contact with the downwardly dropping loops and deflects the loops horizontally from the circular path. The device further includes means for driving the guide element about the circular path for distributing the deflected loops around the axis of the ring-shaped coil. The guide element is arranged centrally in the coil forming chamber. Other means for compacting the packed placement of the individual wire windings into a compact coil whose height is minimized are not part of the device.

EP 0 442 835 B1 discloses a method of forming coils of metal wire in which preshaped wire windings are allowed to drop into a chute which has an essentially cylindrical wall with a vertical axis, wherein the windings are placed on top of each other to form a coil. The method is used in connection with a metal wire which can be attracted by a magnet, wherein an attraction force directed in the direction toward the wall of the chute is exerted on the windings during the free fall of the windings. This force is produced by a rotating magnetic field which penetrates into the interior of the chute to a depth which is at least equal to the difference between the inner diameter of the chute and the diameter of the windings. The direction of the force is determined by rotary movements about the axis of the chute. The magnetic field is produced by electromagnets which are arranged distributed at equal distances around the circumference of the chute and which are cyclically supplied with direct current.

The method is relatively cumbersome and additionally dependent on the susceptibility of the respective wire material.

SUMMARY OF THE INVENTION

Therefore, in view of the prior art discussed above, it is the primary object of the present invention to provide a method and an apparatus for minimizing the coil height of wire coils produced by collecting a plurality of wire windings in a coil forming chamber, wherein it is simultaneously possible to realize a placement of the wire windings in the coil which is as tight as possible, and wherein this can be achieved with means which are as uncomplicated and variable as possible.

In accordance with the present invention, the method includes the steps of placing the wire windings $N_w$ from their drop line eccentrically relative to the axis of symmetry of the coil forming chamber, and adjusting an angle offset $\Delta\phi$ between two successive windings in accordance with the number of wire windings which are placed per 360° in the coil forming chamber, wherein the adjustment is constant or variable, and wherein $\Delta\phi=360°/N_w$.

Accordingly, in accordance with the placement principle of the present invention, the individual windings or winding packets are placed eccentrically with an angle offset relative to each other in the coil forming chamber. Eccentricity and angle offset can be varied for achieving an optimum coil and depend on the wire thickness and the dimensions of the coil forming chamber as well as the rolling speed of the wire or the number of windings per second which drop into the coil forming chamber. The angle offset between two successive windings can be influenced through the number of wire windings which are placed per 360° in the coil forming chamber. Different placement patterns can be achieved either with a constant angle offset or with a variable angle offset between the individually placed windings.

The laying principle described above can be achieved with rotating distributing systems in which the wire windings are placed from their concentric drop lines eccentrically into the coil forming chamber as well as by rotating the coil forming chamber in the case of eccentrically dropping windings.

In accordance with a further development of the method, in which the number of wire windings $N_w$, which are placed over the circumference of the coil forming chamber results from the winding sequence frequency $^{f}{}_{w}$ $$f_w = \frac{\text{rolling speed } ({}^{V}\text{roll})}{\text{winding circumference } ({}^{U}\text{wind})} = \frac{{}^{V}\text{roll}}{\pi * {}^{D}\text{wind}}$$

in relation to the distribution frequency $f_v$=rate of rotation distribution system or rate of rotation coil forming chamber in $$N_w = \frac{{}^{f}W}{f_v} = \frac{{}^{V}\text{roll}}{f_v * \pi D_{wind}},$$

wherein the distribution frequency is $$f_v = \frac{{}^{V}\text{roll}}{N_w \cdot \pi \cdot D_{wind}},$$

it is provided that, in the case of comparatively thin wire diameters, for example, $D_{wire}$<7 mm, a winding range of between 11 and 36 windings is adjusted per 360° of the coil forming chamber and, in the case of comparatively thick wire diameters, for example, $D_{wire}$>7 mm, a winding range of between 6 and 35 windings per 360° of the coil forming chamber is adjusted.

An optimum range results for the distribution frequency $f_v$ or the number of windings per 360° within which the coil placement or the coil height is at a minimum even in the case of parameter deviations, such as changes of the rolling speed, deviations of the winding diameter, etc. In order to keep the coil height small, the frequency should not drop below a minimum frequency.

The winding layer in front of the conveyor belt produces, in dependence on the rolling speed and the winding diameter, the winding sequence frequency $f_w$ from the relationship of the rolling speed $V_{roll}$, the winding diameter $D_{wind}$ and its rate of rotation. The number of wire windings $N_w$ which are placed within the circumference of the coil forming chamber results from the winding sequence frequency $f_w$ and the distribution frequency $f_v$, for example, the rate of rotation of the distribution system or the rate of rotation of the coil forming chamber.

In the case of comparatively thin wire diameters ($D_{wire}$<7 mm), the optimum number of windings per 360° is a range of about 11 to 36 windings and, in the case of thicker dimensions ($D_{wire}$>7 mm), the optimum number of windings per 360° is in a range of about 6 to 35 windings, i.e., the minimum frequency is reduced in the case of thicker cross-sections as compared to thinner wire diameters.

In accordance with a further development of the method, wherein the maximum eccentric displacement of the wire windings in the direction of the outer limits of the coil forming chamber or the maximum eccentricity of the windings dropping into the coil forming chamber depend on the geometry of the coil forming chamber and the thickness of the wire, the maximum possible displacement $ds_{max}$ of the winding center points is adjusted relative to the coil forming chamber (BBK) at $$ds_{\max} = \frac{{}^{D}BBK - {}^{D}wire - {}^{D}wind}{2}.$$

Consequently, another further development of the method provides that the optimum distribution frequency $f_v$ for the wire thickness dimensions $D_{wire}$<7 mm is adjusted between 0.8 Hz and 2.55 Hz, and for the wire dimensions $D_{wire}$>7 mm between 0.25 Hz and 1.6 Hz.

In accordance with another laying principle of the method for minimizing the coil height of the above-described type, the wire windings are placed with different winding diameters $D_{wind}$ so as to form a spirally shaped coil formation, and the winding diameter $D_{wind}$ is varied by changing the rotational speeds of the coil forming chamber.

In accordance with a further development of this method, the rotational speed of the coil forming chamber is preferably subjected to periodic changes.

In accordance with another feature of this method, the speed patterns are adjusted in accordance with sinusoidal or sawtooth functions. Also used can be, for example, sawtooth-like patterns with changeable inclinations of the sides of the teeth.

Another development of the method provides that the placement of the wire windings in the coil forming station or on a receiving element can take place centrically or eccentrically. In the case of an eccentric placement, a combination of different laying principles according to the invention is provided.

In addition, the diameters of the individual windings can be varied between a minimum value and a maximum value, wherein the diameter of the wire windings in the coil forming chamber in approximated dependency on the winding sequence frequency $f_w$, the distribution $f_v$ and the winding diameter $D_{wind}$ on the conveyor belt is as follows:

$$D = \frac{{}^{w}Wind}{1 + \frac{fv}{f_w}}.$$

An apparatus for minimizing the coil height of wire coils produced by collecting a plurality of wire windings in a coil forming chamber, for carrying out the method of the present invention, provides that the coil forming chamber includes a driveable internal mandrel which is mounted in the coil forming chamber so as to be rotatable about a vertical axis; and a preferably outwardly and obliquely downwardly directed guide means is arranged at the internal mandrel, such that the guide means produces an angle offset $\Delta\phi$ between the wire windings and the axis of the internal mandrel as the mandrel rotates, or that the guide means also carries out relative movements about the internal mandrel.

In accordance with a further development of the apparatus, the drive of the internal mandrel includes means for changing the rate of rotation. The rate of rotation may either be constant or it also may be periodically changeable. The guide is constructed and arranged in such a way that the windings do not become hooked into each other and slide down uniformly.

In accordance with an alternative apparatus for carrying out the method according to the present invention, the coil forming chamber is rotatable about a vertical axis and is arranged eccentrically relative to the drop direction of the windings.

In that case, an angle offset between the windings is achieved by turning the coil or the coil forming chamber, so that a laying principle corresponding to the previously described apparatus is achieved.

In addition, friction between the wire and the outer wall of the coil forming chamber can be prevented by rotating, for example, the outer wall of the coil forming chamber. The rate of rotation as well as the offset of the coil forming chamber relative to the drop line of the windings may be adjustable. In that case, the placement of the wire windings takes place without contact, depending on the rate of rotation of the coil forming chamber and the eccentricity of the coil forming chamber. Consequently, in the case of higher rates of rotation of the coil forming chamber, there are no problems, for example, due to contact and/or sparks produced by friction between the distribution system and the wire windings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
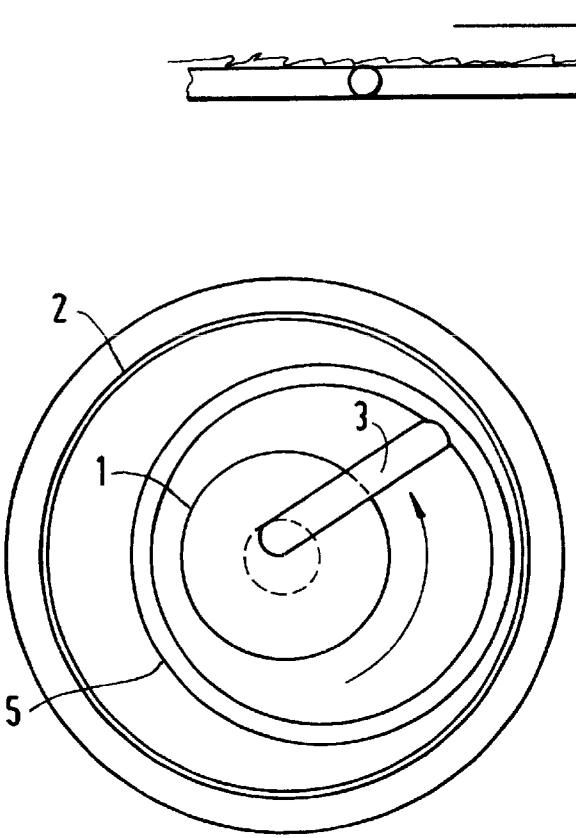
FIG. 1 is a top view of a coil forming chamber with an internal mandrel and a guide means arranged on the internal mandrel.

FIG. 1 of the drawing is a top view of a coil forming chamber 2 with an internal mandrel 1 and an approximately radially directed guide member 3 mounted on the internal mandrel 1. The guide member 3 has the effect that the individual windings 5 are placed eccentrically with an angle offset relative to each other in the coil forming chamber 2. Depending on the configuration and the dimensions of the guide member 3 and the internal diameter of the coil forming chamber, the eccentricity and angle offset $\Delta\phi$ can be varied for obtaining an optimum coil in dependence on the rate of rotation of the inner mandrel 1 in relation to the rolling speed of the wire or the number of windings 5 per second. The wire thickness $D_{wire}$ of each winding 5 also has a determining influence.

Figure 2:
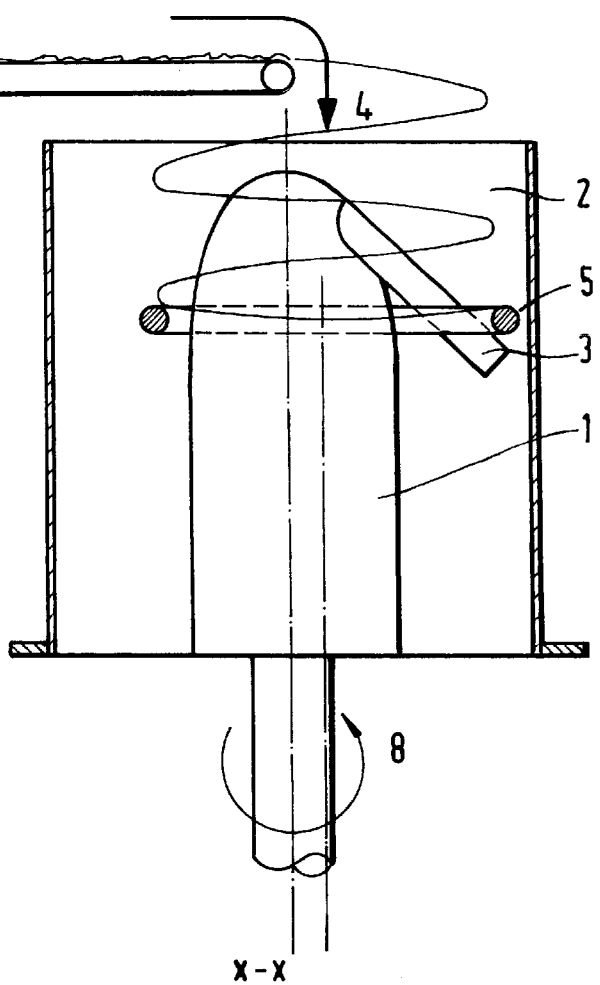
FIG. 2 is a side view of the coil forming chamber of FIG. 1 with internal mandrel and guide means.

FIG. 2 is a schematic illustration of the conveyor 6 with the conveying direction 7 and the drop direction 4 at the end of the conveyor 6. Wire windings 5 drop onto the rotating inner mandrel 1 with the guide member 3 and are placed eccentrically in the coil forming chamber 2.

With respect to the distribution frequency $f_v$ or a number of windings per 360°, there is an optimum range in which the coil formation or the coil height is at a minimum even in the case of parameter variations, for example, changes of the rolling speed, deviations of the winding diameter, etc. In order to keep the coil height low, the frequency should not drop below a minimum frequency.

Figure 3:
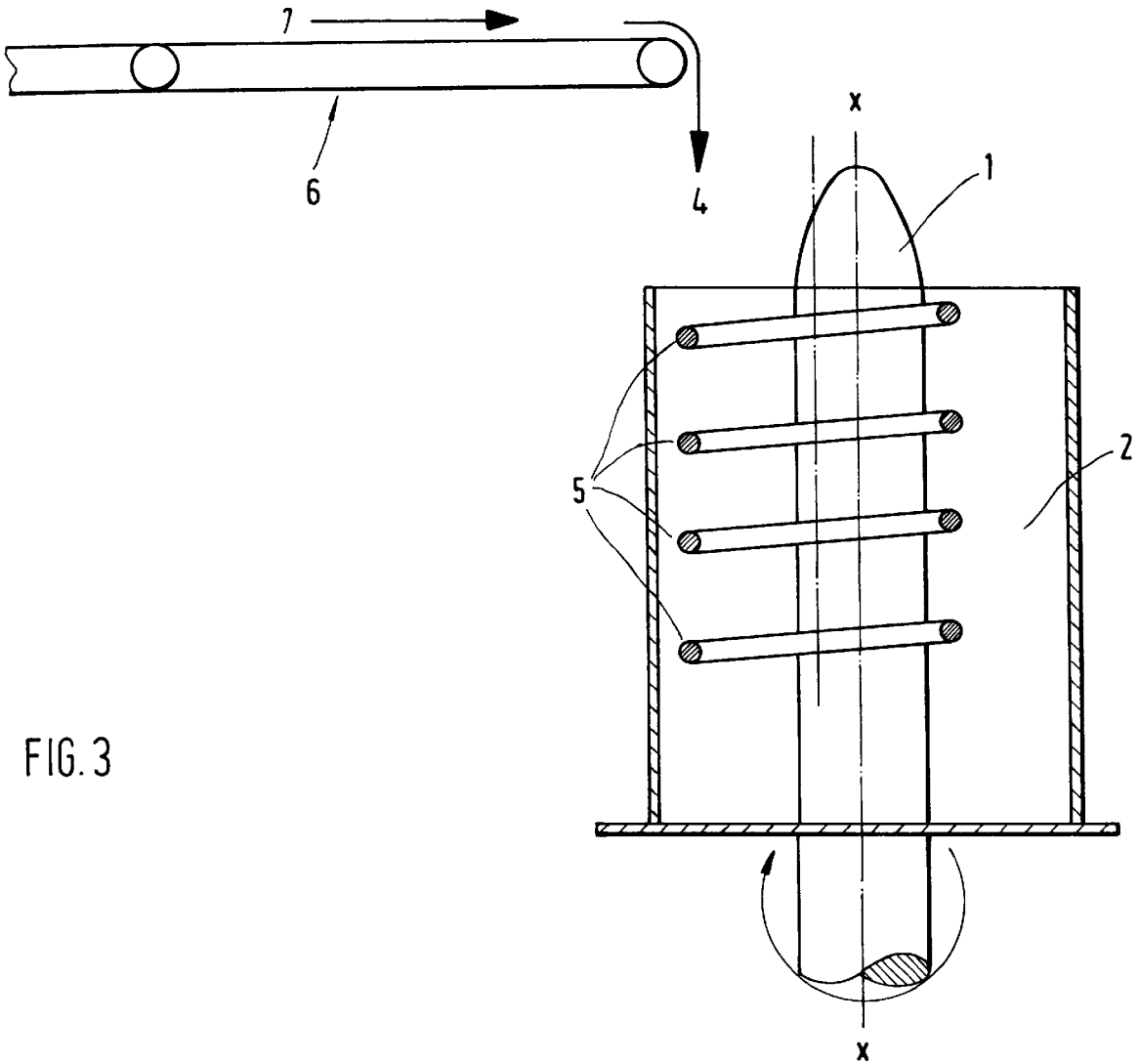
FIG. 3 is a side view of a coil forming chamber with an axis of rotation which is eccentric relative to the drop direction of the wire windings.

FIG. 3 of the drawing shows a laying principle in which the coil forming chamber 2 with the inner mandrel 1 is mounted eccentrically relative to the drop direction 4 of the arriving windings 5.

Figure 4:
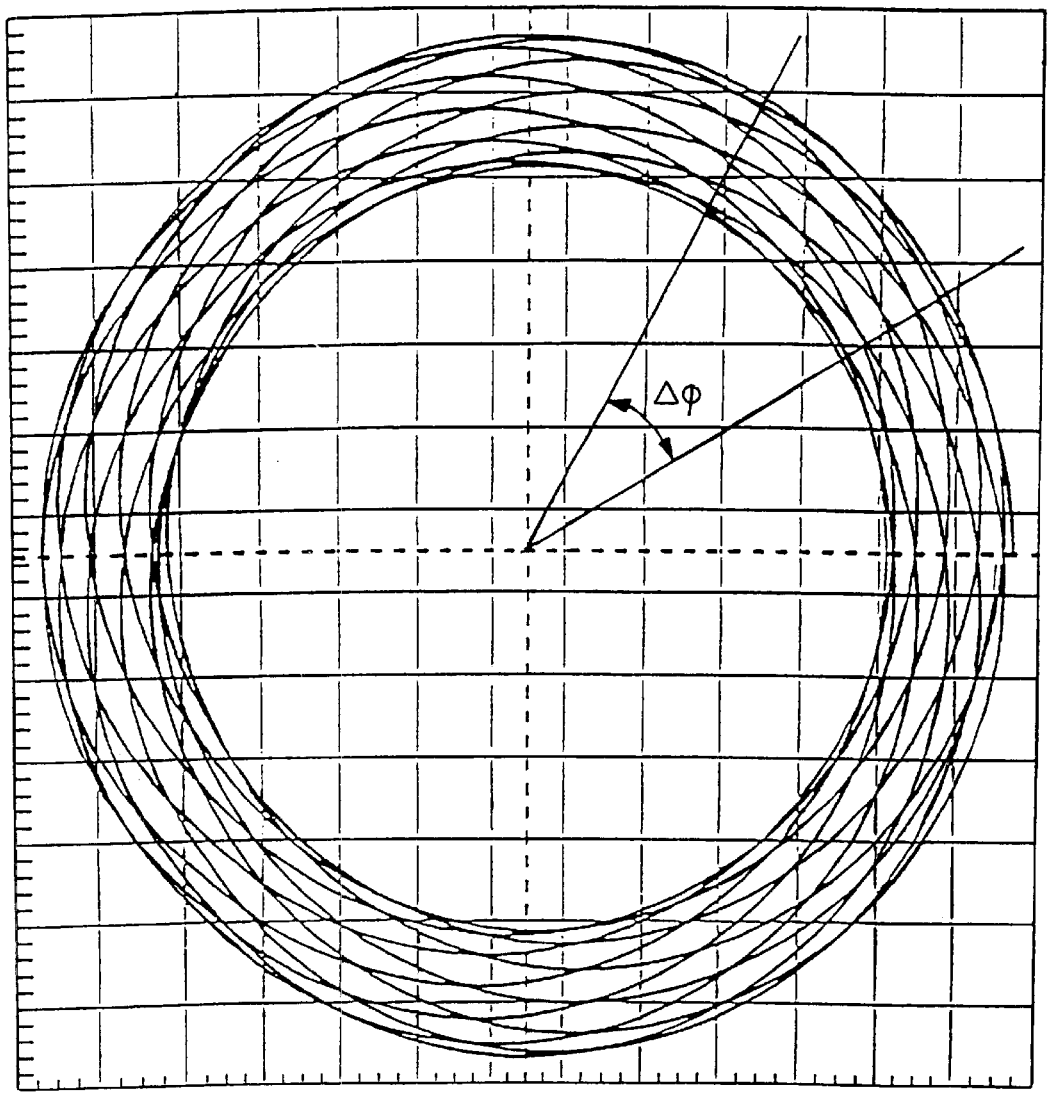
FIGS. 4 to 6 are top views of different placement patterns of wire coils formed using the method according to the present invention.
Figure 5:
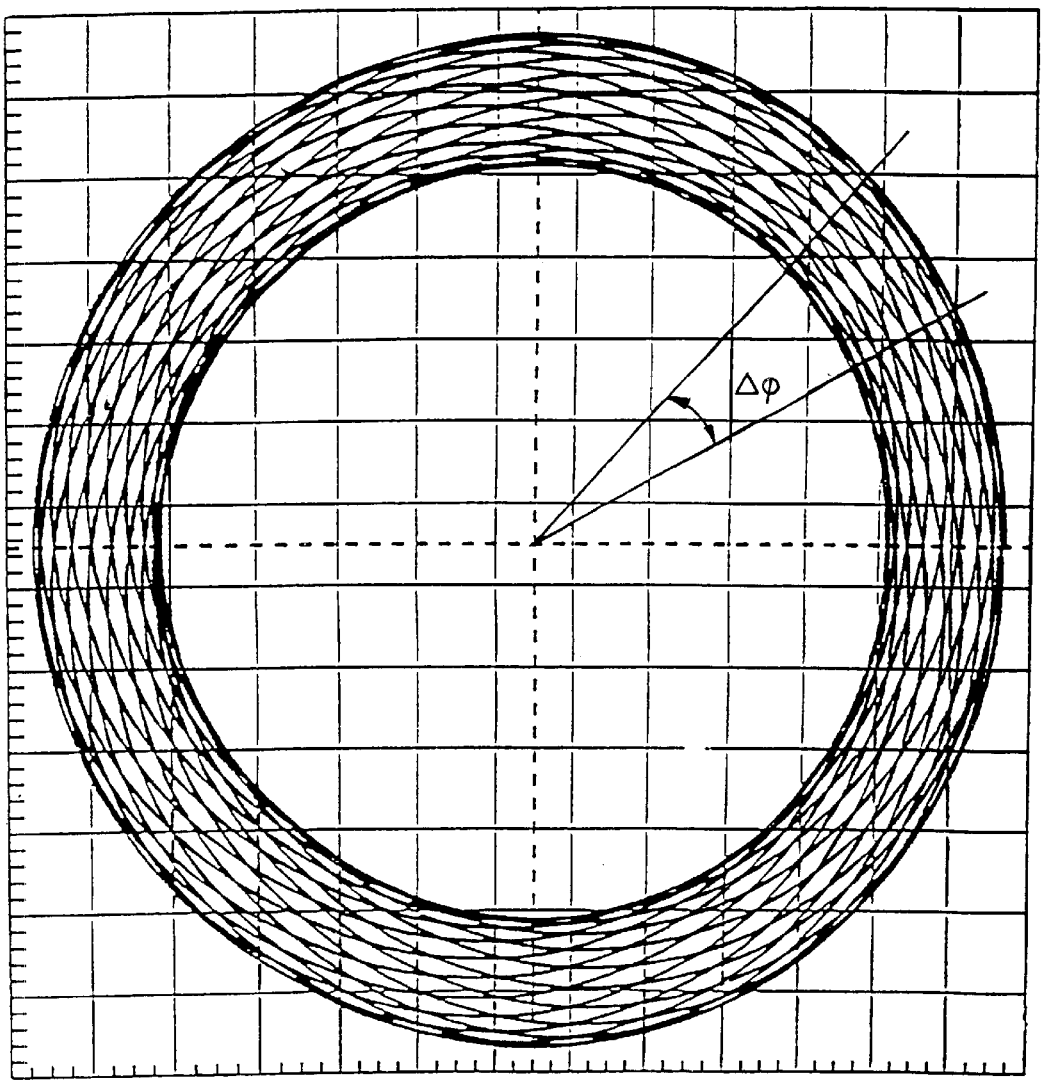

As illustrated, for example, in FIGS. 4 and 5, the angle offset $\Delta\phi$ between two successive windings 5 can be influenced through the adjustment of the number of wire windings 5 which are placed per 360° in the coil forming chamber 2. In the case of a greater angle $\Delta\phi$, the placement pattern, for example, according to FIG. 4, is more loose, while, in the case of a smaller angle offset $\Delta\phi$, the placement pattern is more narrowly meshed. In that connection, the wire thickness is a significant influence which, for example, in a placement pattern according to FIG. 4, may be greater than is the case in a placement pattern according to FIG. 5, as is apparent from viewing these two Figures. A more narrowly meshed placement pattern according to FIG. 5 can be achieved more easily, for example, with a relatively thin wire, while the placement according to FIG. 4 is better suited for greater wire thicknesses.

The laying principle describing above can be produced using rotating distribution systems, for example, the guide member 3 illustrated in FIGS. 1 and 2, as well as by rotating the coil forming chamber 2 with eccentrically dropping windings, for example, as shown in FIG. 3.

Figure 6:
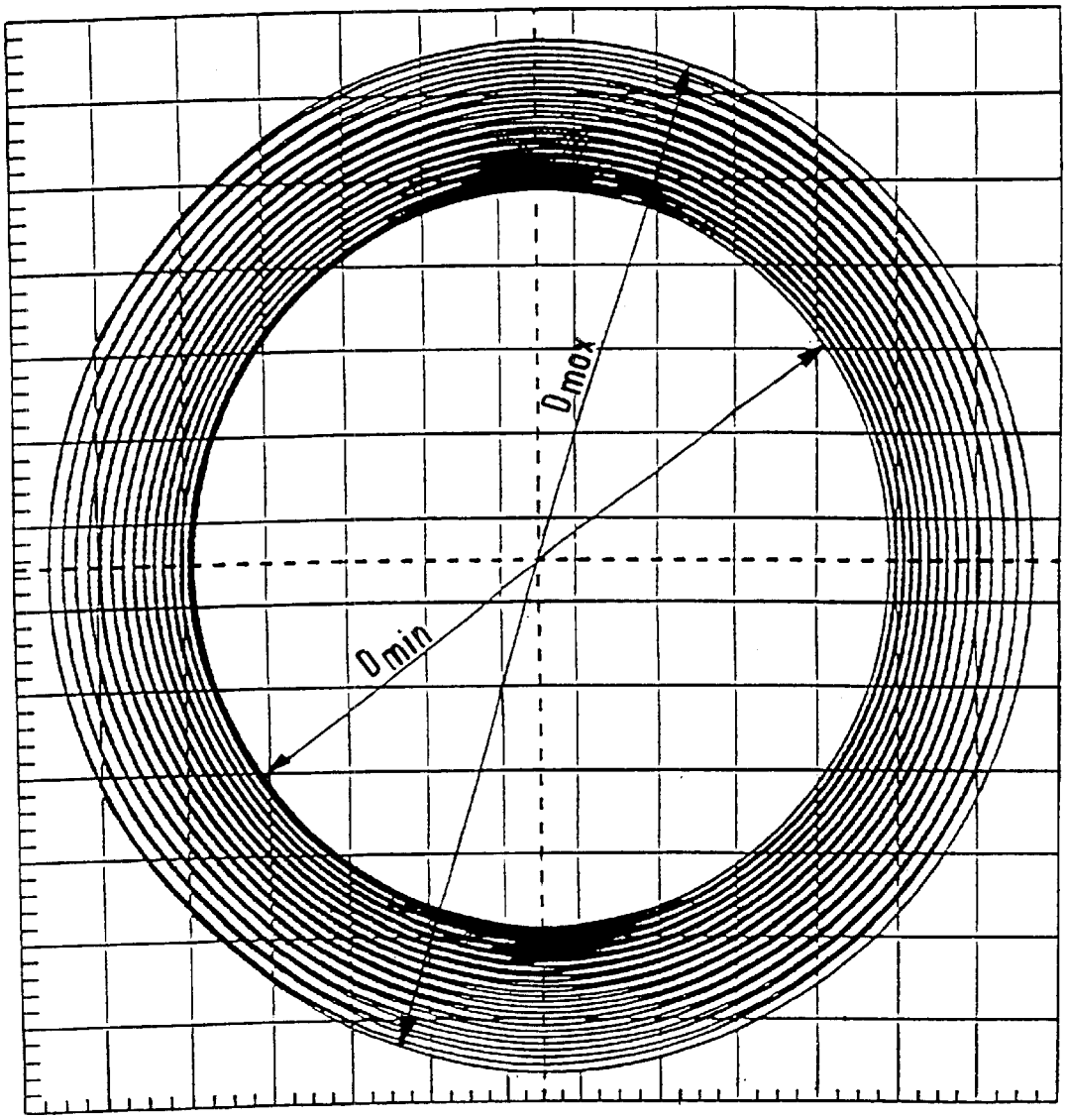

The placement pattern shown in FIG. 6 is the result of an alternative laying principle in which wire windings with different winding diameters $D_{min}$ or $D_{max}$ are placed in such a way that a spirally-shaped coil formation is produced. The diameter variation can advantageously be achieved by varying the speed of rotation of the coil forming chamber 2. Different speed patterns can be used. Periodic speed changes are advantageous for achieving a uniformly repeated winding placement between two desired winding diameters, as illustrated in a top view in FIG. 6 in connection with a typical winding pattern.

Possible speed patterns may be, for example, sinusoidal or sawtooth functions with or without offset. Also conceivable are sawtooth-like patterns with changing inclinations of the side of the teeth. The placement of the wire windings in the coil forming chamber or on a placement platform can be carried out centrically or eccentrically. In the case of the eccentric placement, a combination of the laying principle with eccentric wire placement and the other type of laying principle with windings 5 dropping eccentrically relative to the axis of rotation is obtained.

The diameters of the individual windings 2 can be varied between a minimum value and a maximum value. The limits result from the dimensions of the coil forming chamber.

Figure 7:
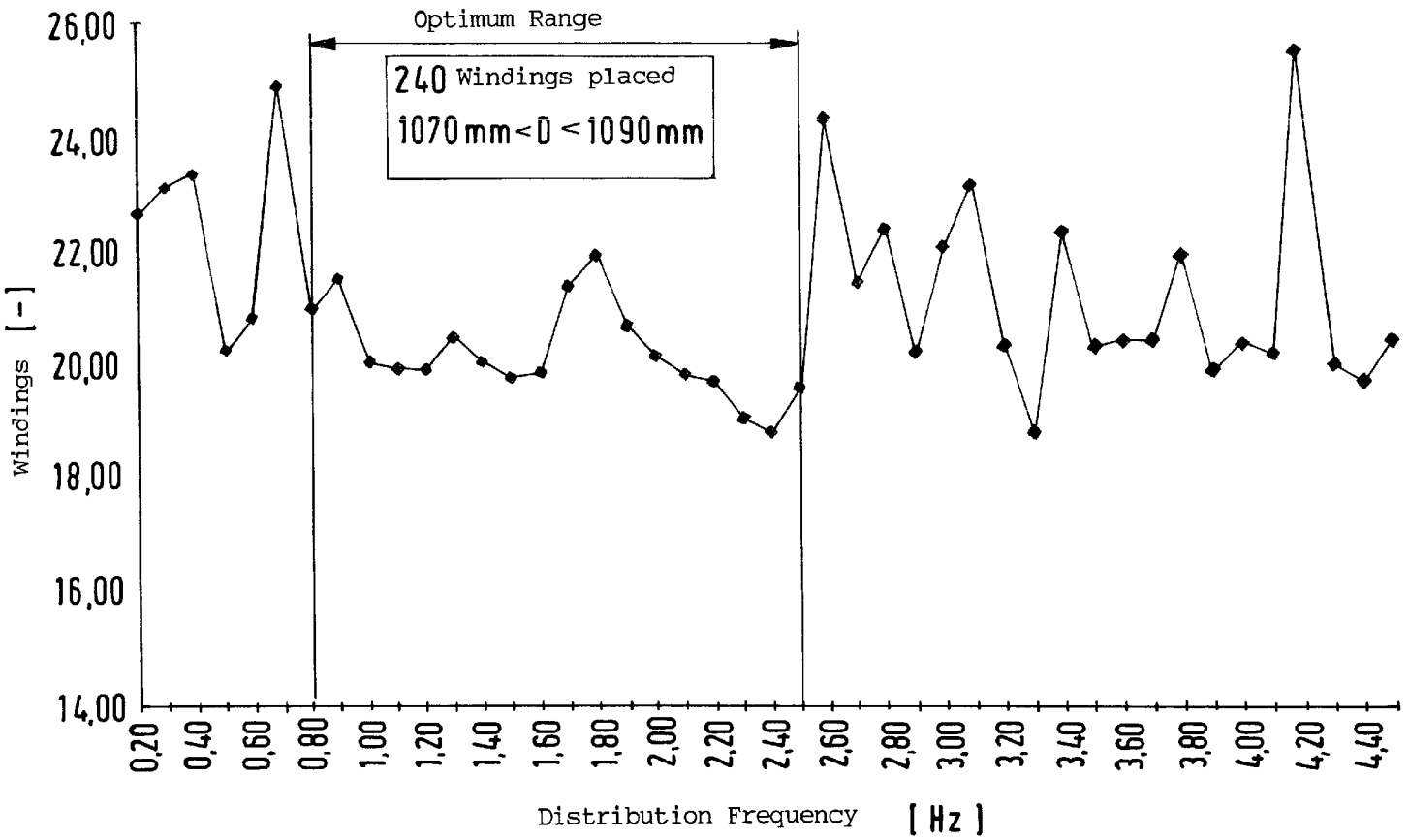
FIG. 7 is a diagram showing the optimum distribution frequency for wire thicknesses of <7 mm.
Figure 8:
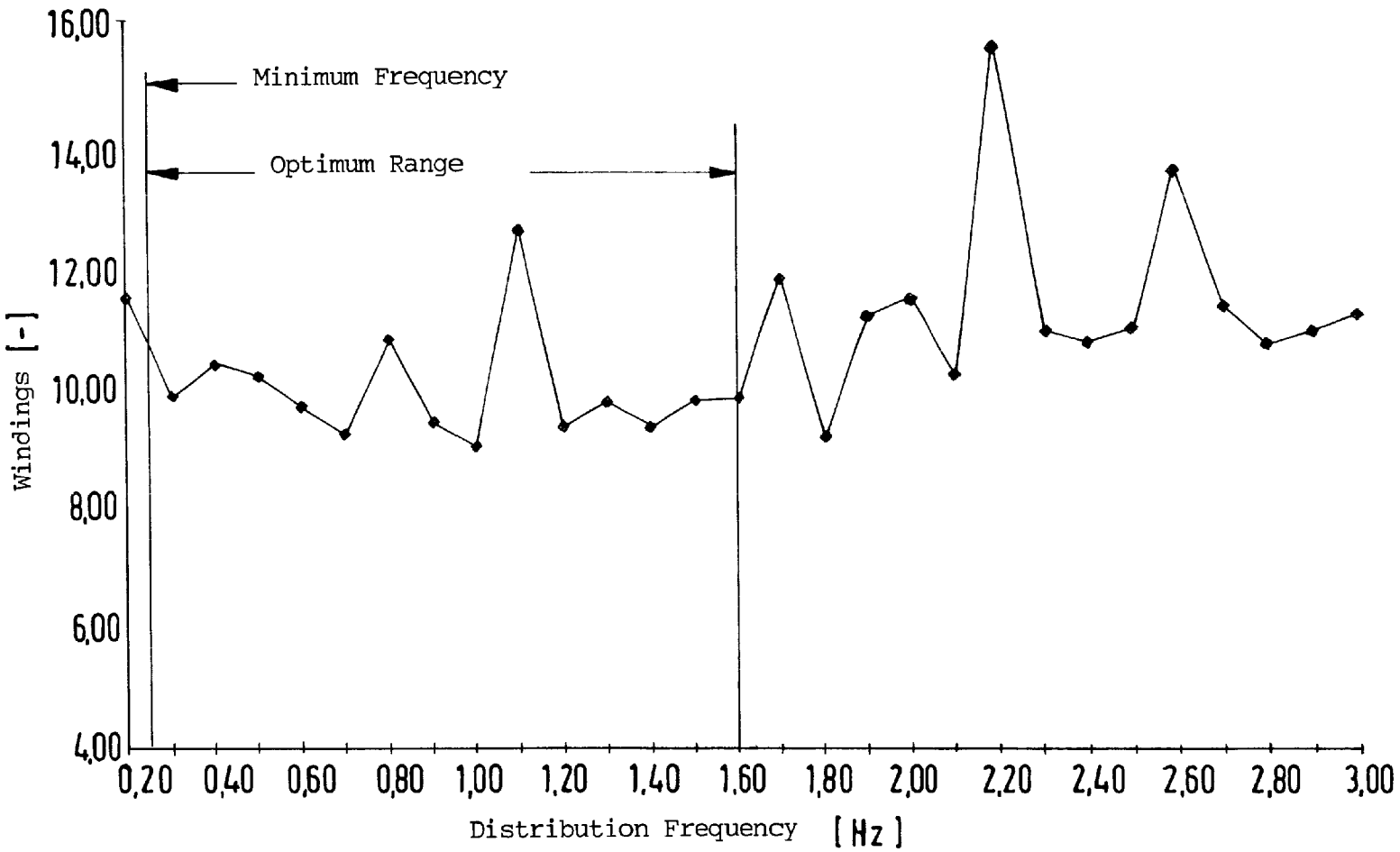
FIG. 8 is a diagram showing the optimum distribution frequency for wire thicknesses of >7 mm.

Finally, FIG. 7 shows a diagram of the optimum distribution frequency $F_v$ for wire thicknesses of <7 mm, while FIG. 8 shows a diagram of the optimum distribution frequency $f_v$ for wire thicknesses of >7 mm.

In the case $D_{wire}$<7 mm, the optimum range of the distribution frequency $f_v$ is between 0.8 and 2.55 Hz, while the optimum distribution frequency $f_v$ for wire thicknesses $D_{wire}$>7 mm is between 0.25 Hz and 1.6 Hz.

While specific embodiments of the invention have been shown and described in detail to illustrate the inventive principles, it will be understood that the invention may be embodied otherwise without departing from such principles.

We claim:

1. A method of minimizing a coil height of a wire coil produced in a coil forming chamber, wherein individual wire windings are supplied on a horizontal conveyor, the wire windings are dropped at the end of the conveyor in an approximately vertical dropping movement, and the wire windings are dropped into the coil forming chamber so as to form a coil, the method comprising:

dropping the wire windings from a drop line thereof eccentrically relative to an axis of symmetry of the coil forming chamber, and adjusting an angle offset $\Delta\phi$ between at least two successive windings in dependence on a number of wire windings $N_w$ which are placed per 360° in the coil forming chamber, wherein $\Delta\phi=360°/N_w$, wherein the number of wire windings placed in a circumference of the coil forming chamber results from a winding sequence frequency $f_w$ $$f_w = \frac{\text{rolling speed } ({}^{V}\text{roll})}{\text{winding circumference } ({}^{U}\text{wind})} = \frac{{}^{V}\text{roll}}{\pi * {}^{D}\text{wind}}$$

in relation to a distribution frequency $f_v$=rate of rotation distribution system in $$N_w = \frac{{}^{f}W}{f_v} = \frac{{}^{V}\text{roll}}{f_v * \pi D_{wind}},$$

wherein the distribution frequency is $$f_v = \frac{{}^{V}\text{roll}}{N_w \cdot \pi \cdot D_{wind}},$$

the method further comprising adjusting a winding range of between 11 and 36 windings per 360° of the coil forming chamber in the case of thin wire diameters of <7 mm, and a winding range of between 6 and 35 windings per 360° of the coil forming chamber in the case of thick wire diameters of >7 mm.

2. The method according to claim 1, wherein the number of wire windings placed in a circumference of the coil forming chamber results from a winding sequence frequency $f_w$ $$f_w = \frac{\text{rolling speed } ({}^{V}\text{roll})}{\text{winding circumference } ({}^{U}wind)} = \frac{{}^{v}\text{roll}}{\pi * {}^{D}wind}$$

in relation to a distribution frequency $f_v$=rate of rotation distribution system or rate of rotation coil forming chamber in $$N_w = \frac{{}^{f}w}{f_v} = \frac{{}^{V}\text{roll}}{f_v * \pi D_{wind}},$$

wherein the distribution frequency is $$f_v = \frac{{}^{V}\text{roll}}{N_w \cdot \pi \cdot D_{wind}},$$

the method further comprising adjusting a winding range of between 11 and 36 windings per 360° of the coil forming chamber in the case of thin wire diameters, and a winding range of between 6 and 35 windings per 360° of the coil forming chamber in the case of thick wire diameters.

3. The method according to claim 1, wherein a maximum eccentric displacement $ds_{max}$ of the wire windings toward an outer limitation of the coil forming chamber are dependent on a geometry of the windings and a thickness of the wire $D_{wire}$, the method further comprising adjusting the maximum displacement $ds_{max}$ of winding centers relative to the coil forming chamber BBK at $$ds_{\max} = \frac{{}^{D}BBK - {}^{D}wire - {}^{D}wind}{2}.$$

4. The method according to claim 1, comprising adjusting an optimum distribution frequency of between 0.8 Hz and 2.5 Hz for wire diameters of <7 mm, and of between 0.25 Hz and 1.6 Hz for wire diameters of >7 mm.

5. The method according to claim 4, comprising adjusting patterns of the speed of rotation of the coil forming chamber in accordance with sinusoidal or sawtooth functions.

6. The method according to claim 5, comprising using sawtooth patterns with changing inclinations of sides of teeth of the sawtooth function.

7. The method according to claim 4, comprising varying the diameters of the windings between a minimum value and a maximum value, wherein the diameter D of the wire windings in the coil forming chamber in an approximated dependency on a winding sequence frequency $f_w$, a distribution frequency $f_w$ and the winding diameter $D_{wind}$ on the conveyor is $$D = \frac{{}^{W}Wind}{1 + \frac{fv}{f_w}}.$$

8. The method according to claim 1, comprising placing the wire windings in the coil forming chamber one of centrically and eccentrically.

9. The method according to claim 1, comprising constantly adjusting the angle offset.

10. The method according claim 1, comprising variably adjusting the angle offset.

11. The method according to claim 1, wherein a maximum eccentric displacement $ds_{max}$ of the wire windings toward an outer limitation of a maximum of eccentricity of windings dropping into the coil forming chamber are dependent on a geometry of the windings and a thickness of the wire $D_{wire}$, the method further comprising adjusting the maximum displacement $ds_{max}$ of winding centers relative to the coil forming chamber BBK at $$ds_{\max} = \frac{{}^{D}BBK - {}^{D}wire - {}^{D}wind}{2}.$$

12. A method of minimizing a coil height of a wire coil produced by collecting a plurality of wire windings in a coil forming chamber, wherein individual wire windings are supplied on a horizontal conveyor, the wire windings are dropped at the end of the conveyor in an approximately vertical dropping movement, and the wire windings are dropped into the coil forming chamber so as to form a coil, the method comprising:

placing wire windings with different winding diameters so as to form a spirally-shaped coil formation, and varying the winding diameters by changing a speed of rotation of the coil forming chamber.

13. The method according to claim 12, comprising subjecting the rate of rotation of the coil forming chamber to periodic changes.

14. A method of minimizing a coil height of a wire coil produced in a coil forming chamber, wherein individual wire windings are supplied on a horizontal conveyor, the wire windings are dropped at the end of the conveyor in an approximately vertical dropping movement, and the wire windings are dropped into the coil forming chamber so as to form a coil, the method comprising:

dropping the wire windings from a drop line thereof eccentrically relative to an axis of symmetry of the coil forming chamber, and adjusting an angle offset $\Delta\phi$ between at least two successive windings in dependence on a number of wire windings $N_w$ which are placed per 360° in the coil forming chamber, wherein $\Delta\phi = 360°/N_w$, wherein the number of wire windings placed in a circumference of the coil forming chamber results from a winding sequence frequency $f_w$ $$f_w = \frac{\text{rolling speed } ({}^{V}\text{roll})}{\text{winding circumference } ({}^{U}\text{wind})} = \frac{{}^{V}\text{roll}}{\pi * {}^{D}\text{wind}}$$

in relation to a distribution frequency $f_v$=rate of rotation coil forming chamber in $$N_w = \frac{{}^{f}W}{f_v} = \frac{{}^{V}\text{roll}}{f_v * \pi D_{wind}},$$

wherein the distribution frequency is $$f_v = \frac{{}^{V}\text{roll}}{N_w \cdot \pi \cdot D_{wind}},$$

the method further comprising adjusting a winding range of between 11 and 36 windings per 360° of the coil forming chamber in the case of thin wire diameters of <7 mm, and a winding range of between 6 and 35 windings per 360° of the coil forming chamber in the case of thick wire diameters of >7 mm.

* * * * *